US009873204B2

(12) United States Patent
Zuider et al.

(10) Patent No.: US 9,873,204 B2
(45) Date of Patent: Jan. 23, 2018

(54) SHAVING HEAD WITH DOMING CONTROL

(71) Applicant: KONINKLIJKE PHILIPS N.V., Eindhoven (NL)

(72) Inventors: Jasper Zuider, Haren (NL); Robert Godlieb, Drachten (NL); Onno Hoitinga, Nij Beets (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 247 days.

(21) Appl. No.: 14/363,674

(22) PCT Filed: Dec. 12, 2012

(86) PCT No.: PCT/IB2012/057214
§ 371 (c)(1),
(2) Date: Jun. 6, 2014

(87) PCT Pub. No.: WO2013/093718
PCT Pub. Date: Jun. 27, 2013

(65) Prior Publication Data

US 2014/0352153 A1 Dec. 4, 2014

Related U.S. Application Data

(60) Provisional application No. 61/577,391, filed on Dec. 19, 2011.

(51) Int. Cl.
*B26B 19/14* (2006.01)

(52) U.S. Cl.
CPC ..... *B26B 19/141* (2013.01); *B26B 19/14* (2013.01); *B26B 19/143* (2013.01)

(58) Field of Classification Search
CPC ..... B26B 19/14; B26B 19/141; B26B 19/143; B26B 19/145
USPC ..... 30/43.4, 43.5, 43.6, 346.51
See application file for complete search history.

(56) References Cited

U.S. PATENT DOCUMENTS

| | | | | |
|---|---|---|---|---|
| 2,119,284 A * | 5/1938 | Meyer | B26B 19/14 | 30/346.51 |
| 2,282,539 A * | 5/1942 | Bahr | B26B 19/14 | 30/346.51 |
| 3,019,525 A | 2/1962 | Bruecker | | |
| 3,191,297 A * | 6/1965 | Driessen | B26B 19/14 | 30/346.51 |
| 3,648,367 A * | 3/1972 | Tolmie | B26B 19/042 | 30/346.51 |
| 4,393,586 A * | 7/1983 | Hamashima | B26B 19/143 | 30/346.51 |
| 5,408,749 A | 4/1995 | Momose | | |

(Continued)

FOREIGN PATENT DOCUMENTS

| | | | |
|---|---|---|---|
| CA | 2426091 A1 | 10/2003 | |
| CA | 2446334 A1 * | 4/2004 | B26B 19/14 |
| CA | 2536424 A1 | 8/2006 | |

(Continued)

*Primary Examiner* — Jennifer Swinney

(57) ABSTRACT

A cutter unit (1) for a rotary shaver is formed by an outer cutting element or cap (2) which interacts with a rotating inner cutting element or cutter (4) to trap and cut hairs. The cap has an annular shaving track (8) of domed cross-section having slots (30) through which the hairs may protrude. The cutter has a convex upper face (22) to engage the shaving track and a concave forward face (26).

7 Claims, 6 Drawing Sheets

(56) References Cited

U.S. PATENT DOCUMENTS

| | | | | | |
|---|---|---|---|---|---|
| 6,085,421 | A * | 7/2000 | Jorna | ..... | B26B 19/141<br>30/346.51 |
| 2013/0145627 | A1 * | 6/2013 | Murzynski | ..... | B26B 19/14<br>30/43.5 |

FOREIGN PATENT DOCUMENTS

| | | | | | |
|---|---|---|---|---|---|
| CN | 1419999 | A | 5/2003 | | |
| EP | 0652086 | A1 * | 5/1995 | ..... | B26B 19/14 |
| EP | 1566247 | A1 | 8/2005 | | |
| EP | 1787767 | A | 5/2007 | | |
| FR | 1048775 | A * | 12/1953 | ..... | B26B 19/14 |
| FR | 1188529 | A | 9/1959 | | |
| GB | 758287 | A | 10/1956 | | |
| WO | 9950034 | A1 | 10/1999 | | |

* cited by examiner

SHAVING HEAD WITH DOMING CONTROL

CROSS-REFERENCE TO PRIOR APPLICATIONS

This application is the U.S. National Phase application under 35 U.S.C. § 371 of International Application No. PCT/IB2012/057214, filed on Dec. 12, 2012, which claims the benefit of U.S. Provisional Patent Application No. 61/577,391, filed on Dec. 19, 2011, filed on Dec. 19, 2011. These applications are hereby incorporated by reference herein.

BACKGROUND OF THE INVENTION

Field of the Invention

The present invention relates to electric rotary shavers and in particular, to a cutter unit for such shavers having an improved configuration. The invention also relates to a method of manufacturing a cutter and cap for such a cutter unit.

Description of the Related Art

In electric rotary shavers, a cutter unit is formed by an outer cutting element which interacts with a rotating inner cutting element or cutter to trap and cut hairs. The outer cutting element, often known as the cap is generally in the form of an annular shaving track having slots through which the hairs may protrude. The inner cutting element or cutter is generally shaped as a disk having a plurality of upstanding legs carrying blades. The cutter rotates whereby the blades follow the annular track and interact with the slots to cut the hairs. A rotary shaver may have one, two or more such cutter units carried in a shaving head. A popular design is the three cutter head in which three such cutter units are arranged in a triangular configuration. A device of this type is shown in U.S. Pat. No. 5,408,749.

A key feature in the design of a shaving head is the comfort to the user. This requires that cutting takes place smoothly, irrespective of which part of the head is being used, the pressure applied and the direction of movement of the head across the skin. The cutter should cut the hairs cleanly without snagging and skin should not be drawn into the slots or otherwise come into contact with the rotating cutter surfaces. Important considerations in achieving comfort are the cutter or shearing angle enclosed between the front surface of the cutter and the inner surface of the cap. The cutter's legs and front surface are usually angled upwards at a cutter angle of typically 40° to 50° relative to the inner surface of the cap to decrease cutting forces. The cutting edge will typically lie in a radial direction while the slots in the cap may be at a shearing angle of typically 3° to 7° to the cutter. This helps to provide smooth running of the cutter surfaces over the lamellae of the shaving track because the rotating surfaces will always be in contact with the lamellae at some point. Considerable care is taken in achieving the optimal angles for any given cutting configuration.

It has recently been noted that toroidal, domed or donut shaped shaving tracks in the caps are comfortable to the skin. This means that the skin-contact surface of the shaving track is not flat or planar, but instead domed. A device disclosing a domed shaving track is described in CA2536424.

Although such configurations may improve comfort in some aspect they have led to further difficulties in relation to maintaining a desired shearing angle. In particular for a domed track, conventional angled cutters have a curved cutting edge and are unable to maintain a constant shearing angle across the width of the shaving track when the domed shaving track has straight hair-entry slots. This effect may partly be overcome by making the slots in the cap non-linear too, to match the cutter. Such adaptations are however costly, since cutting and grinding procedures required to produce curved slots in the cap material are far more complex than those which may be used to form straight slots.

It would therefore be desirable to provide a cutter unit having a configuration that would at least partially overcome some or all of the above inconveniences.

BRIEF STATEMENT OF THE INVENTION

According to the invention, there is provided a cutter for a rotary shaver comprising a cutter disk or support member having an axis for rotation and a plurality of upstanding legs, each leg terminating in a distal portion having a forward face, angled at a cutter angle $\alpha$ with respect to a direction of movement of the leg and a convex upper face for engagement with a cap. The forward face is concave and the upper face and the forward face intersect each other at a cutting edge. By providing a concave forward face, variations in the angle of the cutting edge with respect to a radial direction can be significantly reduced compared to an angled cutter blade having a convex upper face and a flat forward face. In the present context, the term "forward" is understood to refer to the direction of rotational movement of the cutter and the forward face is therefore the surface which faces the direction of movement. Similarly, the term "upper" is intended to refer to the direction towards the face of a user in the operative position of the shaver, irrespective of whether it is being held vertically, horizontally or otherwise. The term "vertical" may also be used hereinafter to refer to the axial direction and the term "horizontal" may also be used to define directions normal to the axial direction. The cutter angle is also understood to be a positive cutting angle i.e. one in which the forward face is not vertical but where the cutting edge forms a leading edge. The concave forward surface is concave at least with respect to a plane perpendicular to the axis of rotation and at least in the region adjacent to the cutting edge. The upper surface is convex in the plane perpendicular to the direction of movement.

Although reference is given to a cutter disk, it is understood that this is not limiting on the disk having any particular shape. In certain circumstances this element may be termed a support member and may have a star-like configuration with the upstanding legs located at the points of the star. The upstanding legs may themselves be angled to form the distal portion or the distal portion may be formed onto or in the forward surface of the upstanding legs. Although the cutter may be a single element, it will also be understood that the cutter may be formed as an assembly of a number of individual elements. In particular, each leg may be provided with a refraction element or "spider" for engaging and lifting of hairs. Such a retraction element may have the same concave shape as the forward face or may be otherwise shaped as required.

Although improvement and benefits may be achieved by making the forward face of the cutter concave with various profiles, according to an aspect of the present invention, a constant shearing angle may be achieved over the radial extent of a cutter, if the cutting edge lies in a vertical plane i.e. in a plane substantially parallel to the axis of rotation of the cutter. In other words, when viewed axially or in the vertical direction, the cutting edge forms a straight line, at least over that portion which is intended to contact the shaving track formed in the cap. This vertical plane may pass through the axis such that the cutting edge is radially aligned. Alternatively, the cutting edge may be angled slightly with respect to the radial direction.

According to the invention, the cutter angle $\alpha$ is preferably between 35° and 70° to the direction of movement. More preferably this angle may be between 40° and 50°. The skilled person is well aware of the advantages of the choice of this angle according to the shear angle and also the cutting angle of the slot in the cap with which the cutter co-operates.

In a further preferred aspect of the invention, the convex upper face of the cutter is a circular cylindrical face having a first radius R. In this case, the concave forward face may be a circular cylindrical face having a second radius r whereby r is chosen according to the cutter angle such that $r=R/\cos\alpha$. Although a part circular upper face may be preferred for use with a similar shaped shaving track, other irregular shaped shaving tracks may be used and in which case a corresponding irregular, concave shaped forward face can be provided to create the desired straight cutting edge. It is believed that the shaving track and the upper face shape should be projected onto the cutter front faces with a scaling factor of the cosine of the cutter angle. In this manner, a concave front face can be determined that can accommodate for different convex or domed upper surfaces.

In a further aspect of the invention, there is provided a cutter unit for a rotary shaver comprising a cutter rotatable about an axis and a cap, the cap comprising a shaving track having a domed upper or outer surface, a curved lower or inner surface and a plurality of radially extending slots for passage of hairs to be cut, the cutter comprising distal portions that follow the shaving track and have a convex cap engaging face corresponding to the curved lower surface terminating in a cutting edge, wherein the cutting edge and a cutting surface of the slots are angled with respect to each other at a shearing angle and the shearing angle is substantially constant over a radial extent of a slot. The shearing angle may thus be carefully selected to maximize comfort over the full width of the shaving track even for an angled cutter. This is believed to improve shaving comfort and reduce snagging. Although reference is given to the shaving angle being constant over the width of the shaving track, it is nevertheless understood that a slight variation may be permitted.

In the present context, it is understood that the domed upper surface will generally match the curved lower surface for a cap having a constant thickness over the shaving track. This need not however always be the case and the curved lower surface may in fact have a different profile to the upper surface. For the purpose of the present invention, it is the curved lower surface that will generally dictate the geometry of the cap engaging face of the cutter. Furthermore, it is understood that the shaving track will be generally annular and the domed upper surface is therefore toroidal or quasi-toroidal. In one preferred embodiment, the curved lower surface follows the profile of a torus, having a partial circular cross-section. Similarly, although reference is given to a convex upper face to the distal portion, it is understood that this surface will in general be part cylinder shaped, i.e. convex in the radial plane but flat in the circumferential direction corresponding to the direction of movement.

Although reference is given to the slots extending radially, this is not intended to be limiting to a purely radial orientation of the slots and merely denotes that they extend at least partially in a radial direction. In actual fact, the slots are preferably angled slightly to the radial direction. This angle $\beta$ is preferably between 1° and 10°, more preferably between 3° and 7°. It is also noted that while the slots are preferably straight when viewed in the axial direction, they may also be otherwise shaped, including curved, S-shaped, serpentine and the like. The slots may also be of constant width or may vary in width.

According to a further aspect of the invention, the cap may have one or more shaving tracks. In the case of a plurality of shaving tracks, these will generally be concentric with a plurality of cutter elements provided to follow each of the tracks. In a simple embodiment, a single track is present.

The cutter which interacts with the cap may be the cutter as described above or hereinafter to the extent that it fulfills the required geometry to achieve the desired constant shearing angle. It will however be understood that the cap and the cutter unit may additionally have other tracks or regions with cutters operating according to different principles, which do not themselves embody the invention.

The invention furthermore relates to a shaver comprising one or more cutter units as described above and a suitable drive unit for causing rotation of the cutter or cutters. A most preferred configuration has three cutter units arranged at the vertices of an equilateral triangle. The shaver may be electrically powered by battery and/or mains electricity. An alternative embodiment may comprise a pair of cutter units.

According to a still further aspect of the invention, there is provided a method of manufacturing a cutter for a rotary shaver, the method comprising: providing a cutter disk having an axis for rotation; deforming portions of the cutter disk to form upstanding legs; forming an upper convex face on each upstanding leg, the upper convex face being shaped to define a generally toroidal path on rotation of the cutter disk about its axis; forming an angled concave forward face at a distal portion of each upstanding leg, such that. The steps as described will generally be carried out in sequence although it will be understood that the cutting edge may be formed before or after the shaping of the upper face. Preferably the concave forward face is produced by cold-forming. Such procedures may be relatively inexpensive compared to the grinding procedures required to form complex slots in the cap. The whole cutter may be cold formed or stamped from a cutter disk. The concave forward face may be cold-formed by stamping of the cutter in its initial flat form. Then as a subsequent cold-forming step the upstanding legs may be bent upwards to form the overall shape of the cutter.

BRIEF DESCRIPTION OF THE DRAWINGS

The features and advantages of the invention will be appreciated upon reference to the following drawings of a number of exemplary embodiments, in which.

DESCRIPTION OF ILLUSTRATIVE EMBODIMENTS

Figure 1:
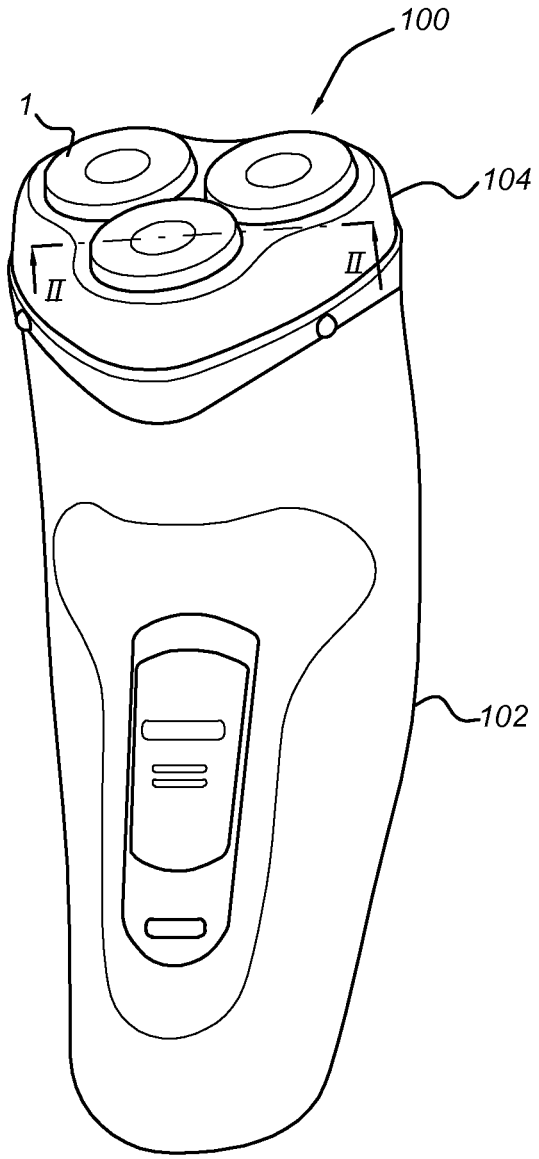
FIG. 1 is a perspective view of an electric shaver incorporating the invention.

FIG. 1 is a perspective view of an electric shaver 100 according to the present invention. The shaver 100 has a handle 102 and a head 104. The head is provided with three cutter units 1 arranged in a triangular shape.

Figure 2:
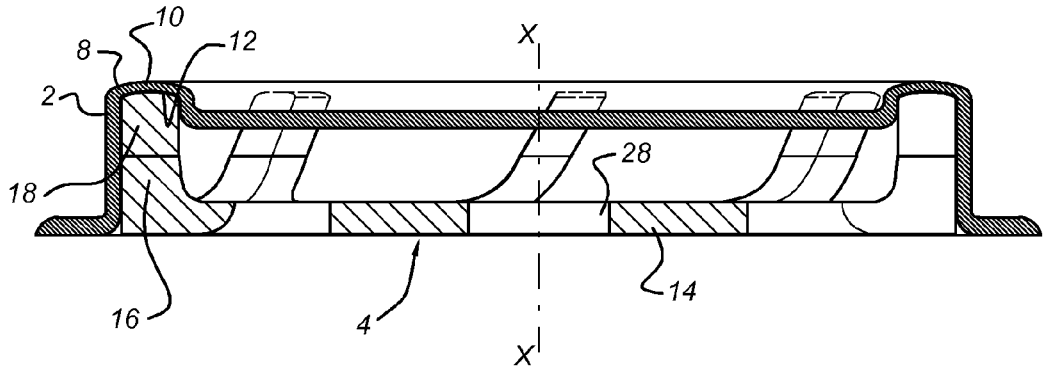
FIG. 2 is a partial cross sectional view of FIG. 1, taken along line II-II.

FIG. 2 shows a cross sectional view through one of the cutter units 1 of FIG. 1, taken along line II. Cutter unit 1 comprises a cap 2 and a cutter 4 which can rotate about an axis X-X. The cap 2 has a shaving track 8 having a domed upper surface 10 and a curved lower surface 12. The cutter 4 comprises a support member or cutter disk 14 having a plurality of upstanding legs 16, each terminating in a distal portion 18 as will be described in further detail below. The distal portions 18 are arranged and shaped to follow the shaving track 8 as the cutter rotates around the axis X-X.

Figure 3:
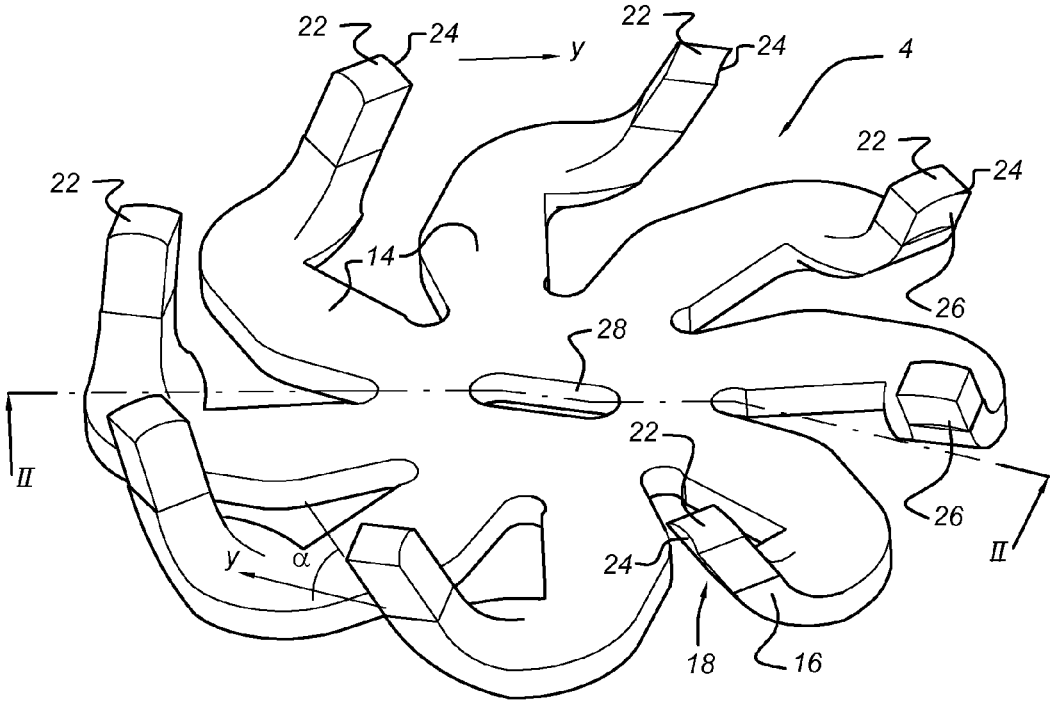
FIG. 3 shows a perspective view of a cutter according to the invention.

FIG. 3 shows a perspective view of the cutter 4 of FIG. 2. As can be seen, each leg 16 extends upwards from the periphery of the cutter disk 14 to a distal portion 18. The distal portion 18 has a convex or cylinder shaped upper face 22 which terminates in a cutting edge 24. The distal portion 18 also has a forward face 26 which intersects with the upper face 22 at the cutting edge 24. The leg 16 and the forward face 26 are angled with respect to a direction of movement Y. This angle is the cutter angle $\alpha$ which in the example is 45°. The cutting edge 24 thus forms a leading edge as the cutter disk 14 rotates. At the centre of the cutter disk 14 a key 28 is provided for interaction with a drive spindle of a drive unit (not shown) of the shaver which may be otherwise conventional.

Figure 4A:
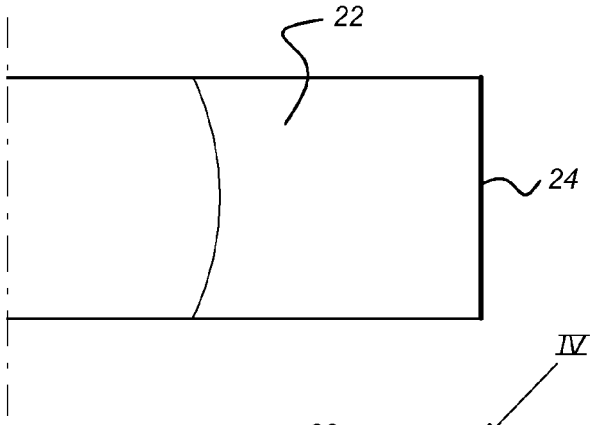
FIGS. 4A to 4C show orthogonal views of the distal portion of a cutter according to an embodiment of the invention.
Figure 4B:
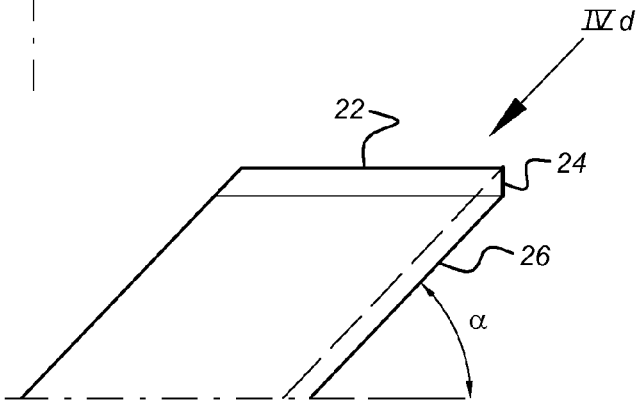
Figure 4C:
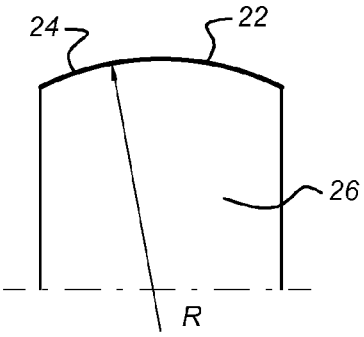
Figure 4D:
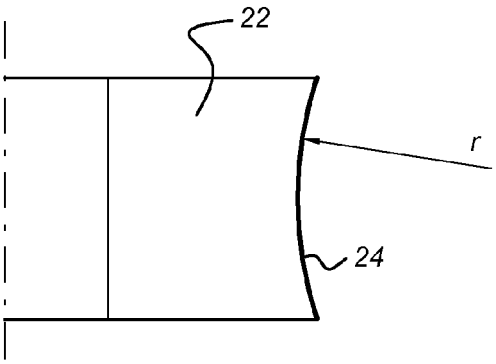
FIG. 4D shows a view taken in the direction of arrow IV in FIG. 4B.

According to the invention, and as can be seen in FIG. 3, the forward face 26 is slightly concave. This is better seen in FIGS. 4A to 4D which show three views of the distal portion 18 in orthogonal projection and an additional view 4D taken in the direction D at the cutter angle $\alpha$. Noticeable is that when viewed in the vertical direction FIG. 4A shows the cutting edge 24 to be a straight line. It is also noted in FIG. 4A that the cutting edge is radial in orientation or in fact lies in a radial plane. This can also be seen in the side view according to FIG. 4B. Viewed in FIG. 4C contrary to the direction of motion, the cutting edge 24 and the upper face 22 appear as a curved line having the same curvature as the lower surface of the cap. The radius of curvature is R which may have a value of around 4 mm. In FIG. 4D, the curvature of the concave forward face 26 is shown to be r. By ensuring that R is equal to r Cos $\alpha$, the two faces will intersect at a cutting edge 24 which lies in the vertical plane.

Figure 5:
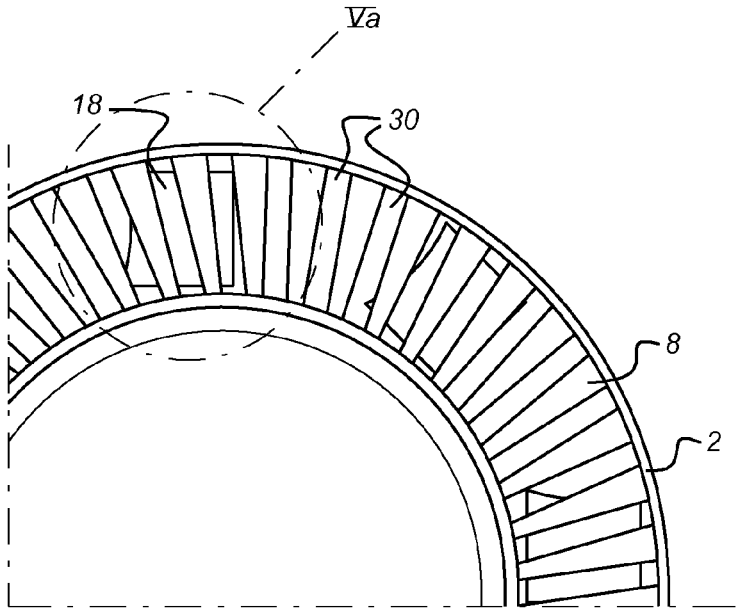
FIG. 5 shows one of the cutter units of FIG. 1 taken in plan view.
Figure 5A:
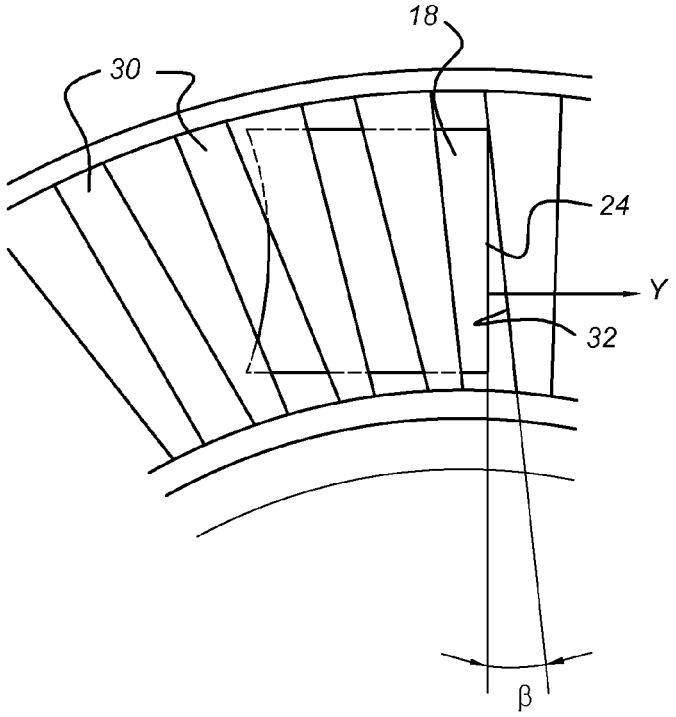
FIG. 5A shows a detail of FIG. 5.

FIGS. 5 and 5A show in detail one of the cutter units 1 of FIG. 1 taken in plan view in the direction of the axis X-X. As can be seen, the cap 2 and the shaving track 8 are provided with slots 30 which extend across the shaving track 8. The slots 30 are oriented at a slight angle $\beta$ to the radial direction. The distal portions 18 can be seen through the slots 30 and have their cutting edges 24 aligned radially whereby a shearing angle $\beta$ is defined between a cutting edge 24 and a cutting surface 32 of a slot 30. It is noted that in this example, the cutter distal portion 18 rotates in a clockwise direction when viewed towards the shaver head. This results in cutting taking place in a shearing motion from an outer edge of the shaving track 8 inwards. It will be understood that the opposite direction of shearing is also possible if desired.

As a consequence of the configuration of the cutting edge 24, a constant shearing angle $\beta$ is achieved over the full length of the slot 30.

Figure 6A:
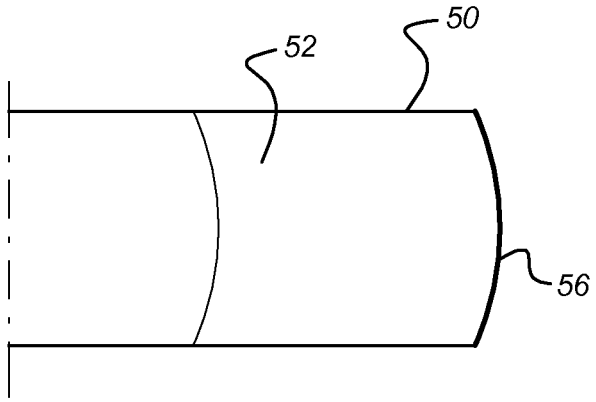
FIGS. 6A to 6C show orthogonal views of the distal portion of a conventional cutter.
Figure 6B:
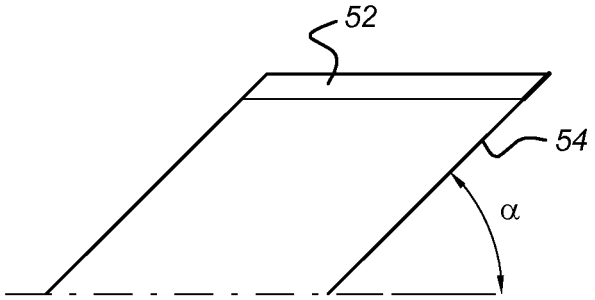
Figure 6C:
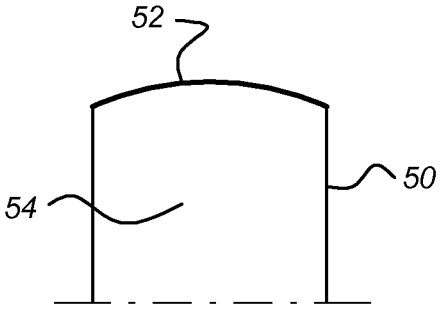

A conventional distal portion 50 is shown for comparison in FIGS. 6A to 6C which show the distal portion in orthogonal projections. As can be seen in the front view of FIG. 6C, this distal portion 50 has a convex upper face 52. Side view FIG. 6B shows the substantially flat forward face 54, angled at the cutter angle $\alpha$. Seen in plan view from above in FIG. 6A, the cutting edge 56 thus forms a curved line lying in the plane of the forward face 54.

Figure 7:
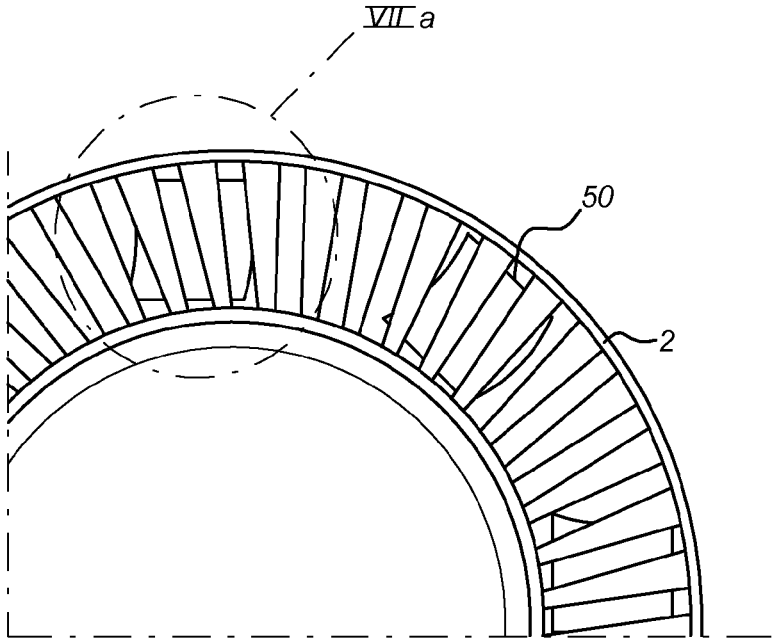
FIG. 7 shows a view of a cutter unit incorporating the conventional cutter of FIGS. 6A to 6C.
Figure 7A:
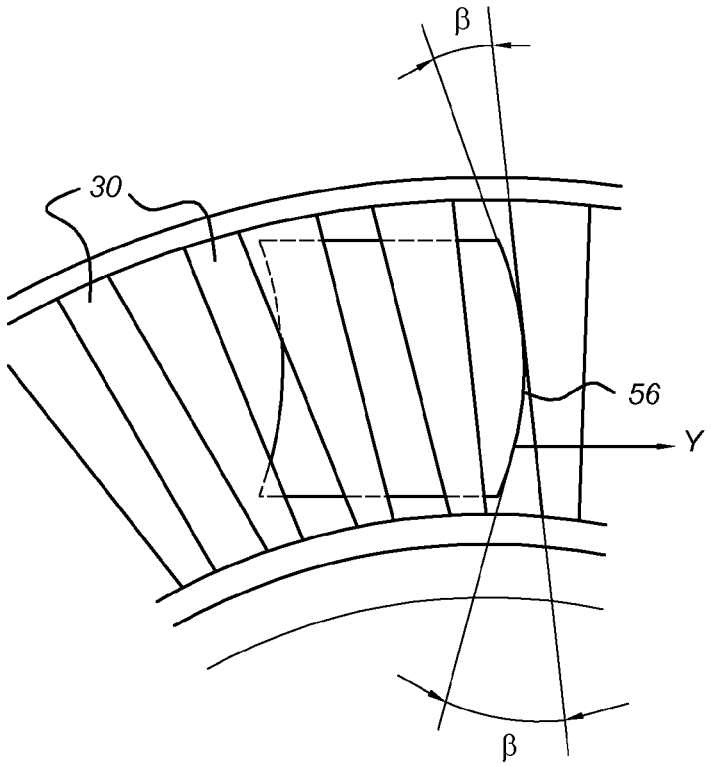
FIG. 7A shows a detail of FIG. 7.

FIGS. 7 and 7A shows similar views to FIGS. 5 and 5A of the cap 2 in operation with the conventional distal portion 50 of FIG. 6. As can be seen, the curved cutting edge 56 causes a variation in the shearing angle $\beta$ between an inner part of the slot 30 and the outer part. This variation in shearing angle means that hairs will not be equally cut at all positions and may be dragged sideways along the slot 30 causing snagging and discomfort.

Thus, the invention has been described by reference to certain embodiments discussed above. It will be recognized that these embodiments are susceptible to various modifications and alternative forms well known to those of skill in the art. In particular, for other, irregular shaped shaving tracks a similar irregular, concave shaped front surface can be made to create a straight cutting edge. The shaving track 'torus' shape can be projected onto the cutter front surfaces with a scaling factor of the cosine of the cutter angle. In this way a concave front surface can be determined that can accommodate for any convex or domed shaving track shape.

Many modifications in addition to those described above may be made to the structures and techniques described herein without departing from the spirit and scope of the invention. Accordingly, although specific embodiments have been described, these are examples only and are not limiting upon the scope of the invention as defined by the appended claims.

The invention claimed is:

1. A rotary shaver, comprising:

a cap comprising one or more annular shaving tracks, the one or more annular shaving tracks comprising a plurality of slots, each slot oriented at an angle ($\beta$) to a radial direction with respect to the axis of rotation, each track having a domed shaped upper surface and a curved shaped lower surface, a cutter unit, comprising a support member having an axis of rotation and carrying a plurality of cutting elements each cutting element comprising:

a leg portion, and a distal portion adjacent the leg portion, wherein the distal portion comprises:

an upper face that is convex having a partial circular cylindrical shape and partially flat in a circumferential direction in a plane perpendicular to a direction of movement, said upper face terminating in a cutting edge lying in a radial plane and wherein said upper face and said cutting edge have a first radius of curvature R, a forward face, having a slightly concave shape angled at a cutter angle ($\alpha$) with respect to a direction of movement of the leg portion relative to the axis of rotation of the support member, wherein the cutter angle ($\alpha$) is between 40° and 50°, said forward face having a second radius of curvature r, wherein said upper face intersects the forward face in said cutting edge forming a straight line when viewed in a vertical direction at least over a portion intended to contact the shaving track formed in the cap, thus allowing a constant shearing angle $\beta$ over over the radial extent of the cutter by ensuring that $R=r\cdot\cos(\alpha)$, wherein the second radius of curvature r depends on the cutter angle ($\alpha$) such that $R=r\cos(\alpha)$ such that the cutting edge will be located at an intersection of the forward face and the upper face.

2. The rotary shaver of claim 1, wherein the curved lower surface has a different profile to the upper surface.

3. The rotary shaver of claim 1, wherein the cutting edge and a cutting surface of at least one of the slots are angled with respect to each other at a shearing angle ($\beta$) and the shearing angle is constant over a radial extent of said at least one of the slots.

4. The rotary shaver according to claim 1, comprising at least two cutter units, each of said at least two cutter units comprising a drive unit to cause rotation of the cutter(s) of the at least two cutter units.

5. The rotary shaver according to claim 1, comprising three cutter units arranged at the vertices of an equilateral triangle.

6. A cutter unit, comprising:

a support member having an axis of rotation and carrying a plurality of cutting elements each cutting element comprising:

a leg portion, and a distal portion adjacent the leg portion, wherein the distal portion comprises:

an upper face that is convex having a partial circular cylindrical shape and partially flat in a circumferential direction in a plane perpendicular to a direction of movement, said upper face terminating in a cutting edge lying in a radial plane and wherein said upper face and said cutting edge have a first radius of curvature R, a forward face, having a slightly concave shape angled at a cutter angle ($\alpha$) with respect to a direction of movement of the leg portion relative to the axis of rotation of the support member, wherein the cutter angle ($\alpha$) is between 40° and 50°, said forward face having a second radius of curvature r, wherein said upper face intersects the forward face in said cutting edge forming a straight line when viewed in a vertical direction at least over a portion intended to contact the shaving track formed in the cap, thus allowing a constant shearing angle $\beta$ over over the radial extent of the cutter by ensuring that $R=r\cdot\cos(\alpha)$, wherein the second radius of curvature r depends on the cutter angle ($\alpha$) such that $R=r\cos(\alpha)$ such that the cutting edge will be located at an intersection of the forward face and the upper face.

7. The cutter unit according to claim 6, wherein the cutting edge and a cutting surface of at least one of the slots are angled with respect to each other at a shearing angle ($\beta$) and the shearing angle is constant over a radial extent of said at least one of a plurality of slots of a cap having one or more annular shaving tracks comprising a plurality of slots.

* * * * *